US006926176B2

(12) United States Patent
Laskey

(10) Patent No.: US 6,926,176 B2
(45) Date of Patent: Aug. 9, 2005

(54) ELLIPTICAL PICK UP TUBE

(76) Inventor: Sandra Jean Laskey, 7311 Waite Dr., Apt. "A", La Mesa, CA (US) 91941

( * ) Notice: Subject to any disclaimer, the term of this patent is extended or adjusted under 35 U.S.C. 154(b) by 0 days.

(21) Appl. No.: 10/350,675

(22) Filed: Jan. 27, 2003

(65) Prior Publication Data

US 2004/0144807 A1 Jul. 29, 2004

(51) Int. Cl.[7] ..... B67D 5/42
(52) U.S. Cl. ..... 222/383.1; 222/464.3
(58) Field of Search ..... 222/321.7, 321.9, 222/382, 383.1, 464.1, 464.3, 464.4; 239/331, 333

(56) References Cited

U.S. PATENT DOCUMENTS 1,152,178 A * 8/1915 Hillyard ..... 222/464.1
2,815,889 A * 12/1957 Stetz et al. ..... 222/464.1
2,849,160 A * 8/1958 Gray ..... 222/383.1
3,301,438 A * 1/1967 Tillotson ..... 222/464.1
4,034,900 A * 7/1977 Hafele ..... 222/321.9
4,286,735 A * 9/1981 Sneider ..... 222/464.1
4,700,892 A * 10/1987 Cunning ..... 222/464.3
5,244,125 A * 9/1993 Robbins, III ..... 222/382
5,390,832 A * 2/1995 Lombardo ..... 222/464.1
5,961,006 A * 10/1999 Dunham et al. ..... 222/383.1
6,036,113 A 3/2000 D'Angelo
6,202,943 B1 3/2001 Evans et al.
6,264,058 B1 * 7/2001 Porter et al. ..... 222/464.1

* cited by examiner

*Primary Examiner*—John J. Vrablik

(57) ABSTRACT

The present invention is generally a flexible tubing to use in such devices as spray bottles, toxic containers, pick up tubes used in medical applications, and in containers in fast food restaurants so that any fluid in the bottom of the container could be immediately and virtually completely removed. The tubing is shaped to conform generally to the bottom of the container, generally in a partial elliptical configuration in a horizontal plane. The tubing or pick up device comprises two parts, normally integrally joined, or fabricated as one piece. More specifically, the upper section of the pick up device is generally vertical, while the lower section is generally in an elliptical configuration. Multiple embodiments exist, including using materials such as rubber, plastic, or metal.

4 Claims, 1 Drawing Sheet

ELLIPTICAL PICK UP TUBE

BACKGROUND OF THE INVENTION

1. Field of the Invention

The present invention relates generally to suction devices, and, more specifically, pick up tubes, such as straws and stems inside containers to draw fluids up the tube.

2. Description of the Related Art

The suction device field includes many different inventions to move fluid through a pick up tube from one location or level to another. Devices using many different styles, materials, and performing varying functions have been patented. More specifically, some examples of such devices are straws, suction tubes, spray nozzles, sprayer containers with stems, and others. Generally, the purpose of these prior art devices is to remove fluid from the container. Despite the crowded field of art, problems remain. Unfortunately, patented inventions in this field still exhibit problems and disadvantages that the present invention has overcome. Even though previous designs have had some success, one long standing problem of prior art devices is an inability to virtually completely remove fluid from a container, in an inexpensive manner, and with a flexible design adaptable to many applications. Given that the purpose of the pick up tube is to remove any fluid in a container, why has there not been a device invented to remove virtually ALL of the fluid?

To date, to the knowledge of the Applicant, no such device has been invented Problems occur if all the fluid is not removed. The partially full container is thrown away, thereby wasting fluid. Or, a new container must be obtained, the top removed, and the contents of the almost empty container poured into the new container! In this case, time is wasted. In some cases the fluid may be a toxic one or inflammable. As a result of toxic fluids, any inconvenience is overshadowed by the very real danger that exists with toxic or noxious fumes, or inflammable vapors. Now the container has been put away without thinking of the danger to children, adults, and property. Even animals can be harmed from inhaling or consuming fluid from discarded containers. An obvious need exists to simplify and improve the process of removing fluid.

One attempt to address these problems in the prior art is D'Angelo, U.S. Pat. No. 6,036,113. This patent discloses dual spray heads, rather than just one. The purpose of two spray heads is to allow the user of the container to spray hard-to-reach areas with one spray head by turning the container upside down. The other spray head is used when the container is right side up; that is in the normal orientation for spray containers. D'Angelo teaches away from the present invention because of the dual spray heads. In addition, D'Angelo does not teach how to efficiently and completely remove all the liquid from a container. Nor does D'Angelo disclose an adaptable design.

Another attempt to solve these aforementioned problems is Evans, et al., U.S. Pat. No. 6,202,943. This patent discloses a complex mechanism for tilting a pick tube in a spray container. The purpose of the mechanism is to remove as much liquid as possible. However, problems still exist with Evans, et al. One problem is the complexity of the tilting mechanism compared to the present invention. Another problem is that the spray container must be tilted in order to remove fluid in the bottom of the container. No such mandatory requirement exists in the present invention. Nor does Evans, et al. disclose an adaptable design.

Many other attempts exist in the prior art to created pick up devices, including straws and spray mechanisms. None offer the simple elegance of the present invention, nor the efficiency in virtually completely removing all liquid in a container in an inexpensive manner, and with a flexible design adaptable to many applications.

In summary, the cited patents have problems and disadvantages. As is quickly realized, the cited patents disclose attempts to solve only one or two problems associated with previous pick up tubes. However, problems still exist in the prior art which have not been addressed to the knowledge of the Applicant. These problems are solved with an elegant, simple, and inexpensive design in the present invention. None of the known prior art devices provides an inexpensive and flexible design adaptable to many applications. The present invention solves these problems that have been virtually ignored.

Therefore, it is an object of the present invention to provide an elegant, simple, and inexpensive design that will virtually completely remove any fluid in a container. Another object of the present invention is to provide a flexible design accommodating the needs of different users and supporting a variety of fluids. The Applicant thinks the present invention overcomes a long-standing and even ignored problem, and dangerous disadvantages of the prior art.

SUMMARY OF THE INVENTION

The above-mentioned difficulties and problems of the prior art are overcome by the present invention. The present invention is generally flexible tubing to use in spray bottles, toxic fluid containers, in pick up tubes used in medical applications, and in containers found in fast food restaurants so that any fluid in the bottom of a container can be immediately and virtually completely removed. More specifically, the flexible tubing has two components; an upper section and a lower section. The upper section is secured, by methods known in the art, to a discharging mechanism at an open end of a container. The lower section is shaped to conform generally to the bottom of the container, essentially in a partial elliptical configuration in a horizontal plane. The two sections of the tubing, or pick up device, may be manufactured so that both sections are removably joined, or the two section may be fabricated as one piece. More specifically, the upper section of the pick up device is generally vertical, while the lower section is generally elliptical. Multiple embodiments exist.

A key novel feature is the shape of the lower section of the pick up tube. This, and other, novel features and advantages of the present invention are set forth more completely in the accompanying drawings and the following description.

BRIEF DESCRIPTION OF THE DRAWINGS

Details of the invention, and of the preferred embodiment thereof, will be further understood upon reference to the drawings, wherein closely related elements have the same number but different alphabetical suffixes, and further wherein.

DETAILED DESCRIPTION OF THE PREFERRED EMBODIMENTS

Figure 1:
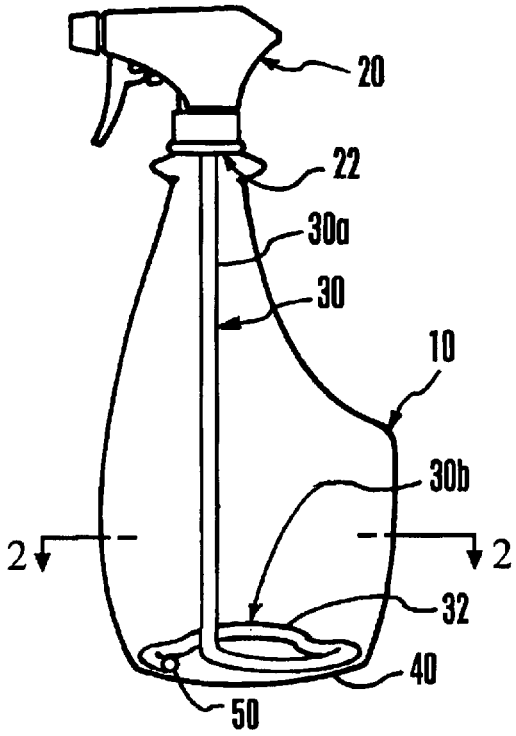
FIG. 1 is a perspective view of a typical spray bottle container of a first embodiment of the present invention, illustrating an arch in a lower section.

The above-mentioned difficulties and problems of the prior art are overcome by the present invention. Referring to FIG. 1, a perspective view of a typical spray bottle container 10 is shown illustrating, most preferably, a first embodiment of the present invention. Also shown is a typical discharging mechanism 20 that is well known in the art. Connected in typical fashion to a bottom part 22 of said discharging device 20 is a pick up device 30. The pick up device 30 is comprised of two sections; an upper section 30*a* and a lower section 30*b*. The lower section 30*b* is formed in a generally elliptical configuration in a horizontal plane. More specifically, the upper section of the pick up device 30 is generally vertical, while the lower section 30*b* is generally elliptical. More specifically, the lower section 30*b* generally conforms to the shape of a bottom 40 of the spray bottle device 10. The two sections 30*a*, 30*b* of the pick up device 30 may be manufactured so that both sections 30*a*, 30*b* are removably joined, or the two sections 30*a*, 30*b* may be fabricated as one piece. Even more specifically, the lower section 30*b* is shown with an arch 32. The arch 32 is formed as a result of manufacturing the lower portion 30*b* with an initially greater diameter than the bottom 40 of the spray bottle device 10. When the pick up device 30 is inserted into the container 10, the lower section 30*b* bends upward in order to fit into the bottom 40. As a result, an open end 50 of the lower section 30*b* is forced into close proximity of the bottom 40. This particular embodiment is ideal for a container 10 with a concave bottom. In such a container 10, the fluid accumulates in the lowest portion of the bottom 40, that is around an outer edge 42 of the bottom 40. With the open end 50 forced into close proximity of the bottom 40, virtually all of the liquid in the container 10 can be easily and quickly removed through the discharging device 20.

Figure 2:
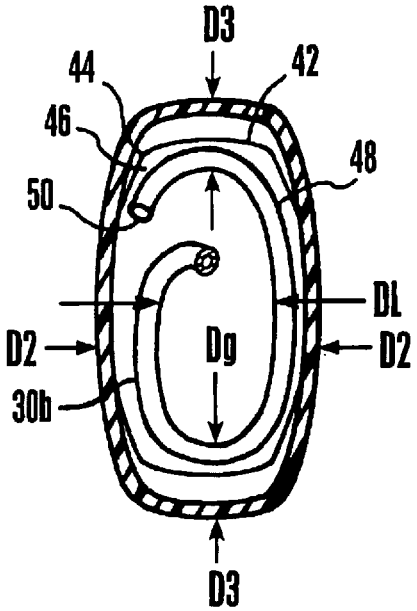
FIG. 2 is the plan view in partial section of the lower section of the first embodiment of the present invention.

Referring now to FIG. 2, a plan view in partial section is shown of the lower section 30*b* of the present invention. Even more specifically, the lower section 30*b* has a lesser diameter Dl and a greater diameter Dg characteristic of a partial elliptical configuration. The diameters, Dl, Dg, are, respectively, initially greater than the bottom . . . diameter(s) D2, D3 of the bottom 40 of the container 10. The purpose of having greater diameters (Dl), Dg, is to allow the lower section 30*b* to generally conform closely to the bottom 40 of the container 10. The angled open end 50 of the lower section 30*b* is preferably smoothed to prevent personal injury during manufacture or during use. The reason for the angled open end 50 is to help ensure all fluid is suctioned out of the container 10. An important feature of the present invention is having the open end 50 pointing generally in the same direction as the direction of spray or discharge of any fluid in the container 10. In addition, the greater diameters Dl, Dg, of the lower section 30*b* are of such dimensions such that the arch 32 in the lower section 30*b* is formed as shown in FIG. 1. When the arch 32 is formed, the open end 50 is more closely confined in a corner 44 of the generally rectangular bottom 40 of the container 10. This feature of the arch 32 in the lower section 30*b* is important for containers having a concave shaped bottom 40, thereby creating a trough 46 around the outer edge 42 of an inner bottom 48 of the container 10. Therefore, it is necessary for the open end 50 to be closely confined in the bottom 40 of the container 10 because the water level will recede to the trough 46 in the bottom 40. If the open end 50 is not confined to the corner 44, or the trough 46, then all the fluid will not be suctioned out as desired. Another reason for this orientation of the open end 50 is to allow residual fluid to accumulate at the open end 50 should the container 10 be tilted in any way. However, it is not necessary to tilt the container when fluid levels are horizontal in a level container.

Figure 3:
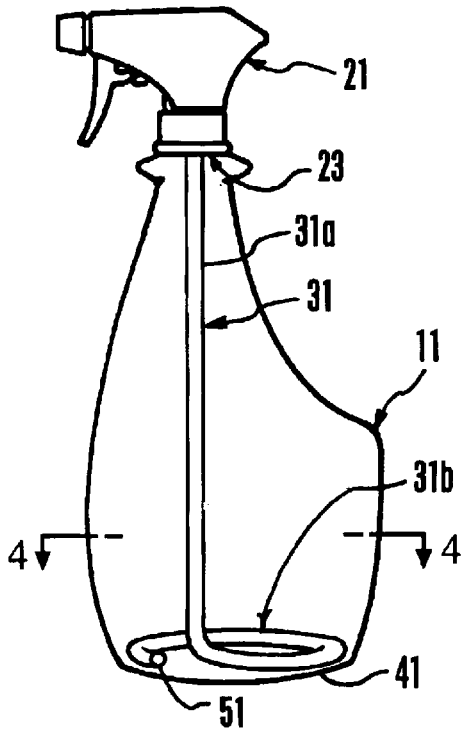
FIG. 3 is a perspective view of a typical spray bottle container of a second embodiment, illustrating a flat lower section of the present invention.

Referring now FIG. 3, a perspective view of a typical spray bottle container 11 is shown illustrating, preferably, a second embodiment of the present invention. Also shown is a typical discharging mechanism 21 that is well known in the art. Connected in typical fashion to a bottom part 23 of said discharging device 20 is a pick up device 31. The pick up device 31 is comprised of two sections; an upper section 31*a* and a flat lower section 31*b*. The lower section 31*b* is formed in a generally elliptical configuration in a horizontal plane. More specifically, the upper section of the pick up device 31 is generally vertical, while the lower section 31*b* is generally elliptical. More specifically, the lower section 31*b* generally conforms to the shape of the bottom 41 of the spray bottle device 11. The two sections 31*a*, 31*b* of the pick up device 31 may be manufactured such that both sections 31*a*, 31*b* are removably joined, or the two sections 31*a*, 31*b* may be fabricated as one piece.

Figure 4:
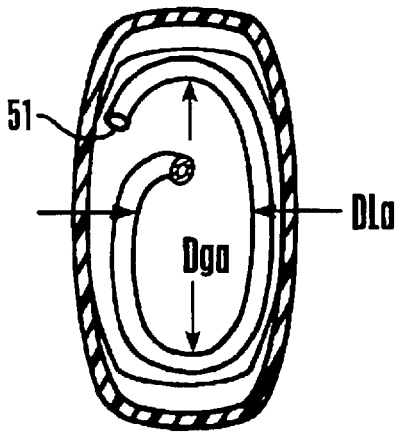
FIG. 4 is the plan view in partial section of the lower section of the second embodiment of the present invention.

Referring finally to FIG. 4, a plan view in partial section is shown of the lower section 31*b* of the second embodiment. Even more specifically, the flat lower section 31*b* has a lesser diameter Dla and a greater diameter Dga characteristic of a partial elliptical configuration An open end 51 of the lower section 31*b* is preferably smoothed to prevent personal injury during manufacture or during use. An important feature of the present invention is having the open end 51 pointing generally in the same direction as the direction of spray or discharge of any fluid in the container 11. The reason for this orientation of the open end 51 is to allow residual fluid to accumulate at the open end 51 should the container 11 be tilted in any way. However, it is not necessary to tilt the container when fluid levels are horizontal in a level container.

The present invention has numerous applications. The flexible pick up device 30 may be used in spray bottles, toxic fluid containers, in pick up tubes used in medical applications, and in containers found in fast food restaurants so that any fluid in the bottom of a container can be immediately and virtually completely removed. Other applications could be in cosmetic containers, lubricants, bug repellants, and hand soap dispensers. Still other applications could be in containers for chemicals, kerosene or gasoline; or other industrial fluids. Another advantage of the present invention is the inexpensive design. Because these pick up tubes are typical produced in great volume, incremental unit savings would produce substantial economic benefits through a lower unit price of any product. Another advantage of the present invention is the design flexibility. The dimensions of the pick up device 30 may be changed to meet the needs of the end user and the specific application. The diameter of the tube may vary. The length of the pick up device 30 may vary. The diameters of the elliptical configuration of the lower section 30*b* may vary as well. Therefore, the design dimensions are flexible. Other advantages of the present invention include fabricating the pick up device 30 in other materials such as metal, plastic, or rubber. These materials provide other embodiments and applications for a variety of uses. For instance, metal tubing may be aluminum or another flexible metal for use in suctioning corrosive, toxic, or other dangerous fluids. Next, flexible rubber may be used in applications for less expensive uses, yet suctioning fluids that a human would not use. Thirdly, flexible plastic is a material that may be used for human use, such as for water, juice, or milkshakes. In addition, plastic may be used for many household cleaner containers. The methods of forming such materials and conforming them to a certain bottom dimension are well known in the fields of manufacturing and materials.

Yet a third embodiment (not shown) of the present invention is a generally elliptical section similar to the lower section described in the first and second embodiments. More specifically, a partial elliptical section may be attached to an existing pick up device. An existing pick up tube may be removed from its container, then severed at a location at a distance below a discharge mechanism at a top of the container. Then the third embodiment may be securely affixed to the remain portion of the existing pick up device. Two methods may be used to affix the elliptical section. First, the elliptical section may be manufactured with an outside diameter sufficiently less than that of the existing pick up device to allow room for an adhesive. Then the elliptical section may be thinly coated inside over a predetermined length with a known non-toxic adhesive, such as a glue known in the art. Next, the elliptical section is slipped over the existing remaining portion of the pick up device and allowed to quickly dry before use.

A second method of affixing the elliptical section to the remaining length of the pick up device is to have the outside diameter of the elliptical section sufficiently less than the inner diameter of the remaining pick up device so that a thin adhesive coating may be applied on the outside of the elliptical section. Next, the elliptical section is slipped into the remaining pick up device and allowed to quickly dry before use.

In both methods, the purpose of applying an adhesive is to prevent leakage of fluid and air when suction is applied to the pick up device.

Consequently, while the foregoing description has described the principle and operation of the present invention in accordance with the provisions of the patent statutes, it should be understood that the invention may be practiced otherwise as illustrated and described above and that various changes in the size, shape, and materials, as well as on the details of the illustrated construction may be made, within the scope of the appended claims without departing from the spirit and scope of the invention

GLOSSARY

10 container
11 container
20 discharging mechanism
21 discharging mechanism
22 bottom part discharging mechanism
23 bottom part discharging mechanism
30 pick up device
30*a* upper section
30*b* lower section
31 pick up device
31*a* upper section
31*b* lower section
32 arch
Dl lesser diameter
Dla lesser diameter
Dg greater diameter
Dga greater diameter
D2 bottom lesser diameter
D3 bottom greater diameter
40 rectangular container bottom
41 container bottom
42 outer edge
44 corner
46 trough
48 inner bottom
50 lower section end
51 lower section end

What is claimed is:

1. A fluid pick up device comprising:

an upper section; and a lower section;

wherein said sections are flexible plastic, and further wherein said lower section is generally in a partial elliptical configuration in a horizontal plane, and further wherein said lower section is proximate to a concave bottom of a container, wherein diameters Dl, Dg, of said lower section are, respectively, initially manufactured greater than diameters D2, D3 of said bottom of said container, and further wherein when said pick up device is inserted into said container, said lower section bends upward forming an arch in order to fit into said bottom and further wherein an open end of said lower section is forced into close proximity of an outer edge of said bottom, wherein when suction is applied to said device, virtually all of said fluid is completely removed through a discharging device.

2. A fluid pick up device according to claim 1, wherein said open end is angled, wherein said angled open end help to ensure all fluid is suctioned out of said container, and further wherein said upper and lower sections are of a one-piece fabricated construction, and further wherein said open end is generally pointed in the same direction as a discharge mechanism of said container, wherein residual fluid accumulates at said open end when said container is tilted in any way, and wherein said fluid in said tilted container is removed.

3. A fluid pick up device comprising:

an upper section; and a lower section;

wherein said sections are flexible plastic, and further wherein said lower section is generally in a partial elliptical configuration in a horizontal plane, and further wherein said lower section is proximate to a flat bottom of a container, wherein diameters Dl, Dg, of said lower section are, respectively, initially manufactured greater than diameters D2, D3 of said bottom of said container, and further wherein when said pick up device is inserted into said container, an open end of said lower section is in close proximity to an outer edge of said bottom, wherein when suction is applied to said device, virtually all of said fluid is completely removed through a discharging device wherein said open end is angled, wherein said angled open end helps to ensure all fluid is suctioned out of said container, and further wherein said upper and lower sections are of a one-piece fabricated construction, and further wherein said open end is generally pointed in the same direction as a discharge mechanism of said container, wherein residual fluid accumulates at said open end when said container is tilted, and wherein said fluid in said tilted container is removed.

4. A method of operation of an elliptical pick up tube comprising the steps of:

manufacturing an elliptical pick up tube;

inserting said pick up tube into a container;

forcing a bottom section of said pickup tube into a concave bottom of said container;

bending said lower section into an arch;

forcing an open end of said lower section into said bottom of said container;

suctioning fluid from said container; and removing virtually all of said fluid from said container through a discharge mechanism.

* * * * *